US007712741B2

(12) United States Patent
Lambert

(10) Patent No.: US 7,712,741 B2
(45) Date of Patent: May 11, 2010

(54) DOUBLE SIDED SCRATCH-OFF LOTTERY TICKETS AND METHODS OF MANUFACTURING THE SAME

(75) Inventor: Claude Lambert, Montreal (CA)

(73) Assignee: Oberthur Gaming Technologies Inc., Montreal, Quebec (CA)

( * ) Notice: Subject to any disclaimer, the term of this patent is extended or adjusted under 35 U.S.C. 154(b) by 31 days.

(21) Appl. No.: 11/225,351

(22) Filed: Sep. 13, 2005

(65) Prior Publication Data

US 2006/0055108 A1 Mar. 16, 2006

(51) Int. Cl.
*A63F 3/06* (2006.01)

(52) U.S. Cl. ..... 273/139; 283/901; 283/903

(58) Field of Classification Search ..... 273/139, 273/269; 283/901, 903
See application file for complete search history.

(56) References Cited

U.S. PATENT DOCUMENTS

| | | | | |
|---|---|---|---|---|
| 5,217,258 | A | 6/1993 | Sanderson | |
| 5,451,052 | A * | 9/1995 | Behm et al. | 273/139 |
| 5,562,284 | A * | 10/1996 | Stevens | 273/139 |
| 6,308,991 | B1 | 10/2001 | Royer | |
| 6,347,794 | B2 * | 2/2002 | Scrymgeour et al. | 273/138.1 |
| 6,599,187 | B2 * | 7/2003 | Gerow | 463/17 |
| 2003/0184012 | A1 | 10/2003 | Green | |
| 2004/0140616 | A1 * | 7/2004 | Davis | 273/292 |

FOREIGN PATENT DOCUMENTS

| | | | |
|---|---|---|---|
| CA | 2066489 | | 5/1995 |
| CA | 2282768 | | 9/2000 |
| CA | 2282770 | | 9/2000 |
| CA | 2282777 | | 10/2000 |
| CA | 2 451 788 | A1 | 3/2004 |
| CA | 2359581 | | 3/2004 |
| GB | 2148795 | A * | 6/1985 |
| WO | WO 01/23054 | A1 | 4/2001 |

* cited by examiner

*Primary Examiner*—Benjamin H Layno
(74) *Attorney, Agent, or Firm*—Dority & Manning, P.A.

(57) ABSTRACT

A lottery ticket and continuous process of forming the same in which the front and rear surfaces of the lottery ticket and provided with scratch-off lottery games which may be accessed by the player without first having to remove a break-open window.

9 Claims, 5 Drawing Sheets

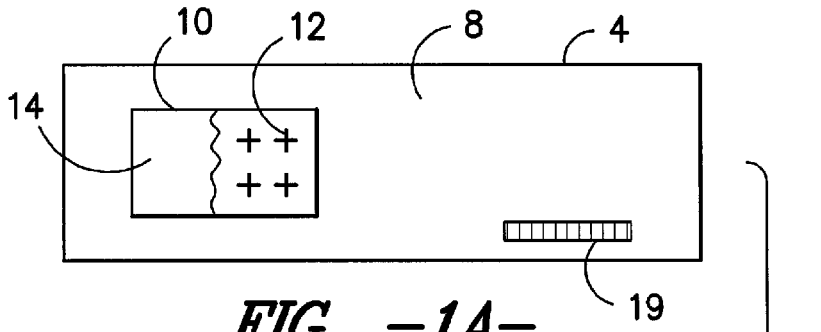
FIG. –1A–
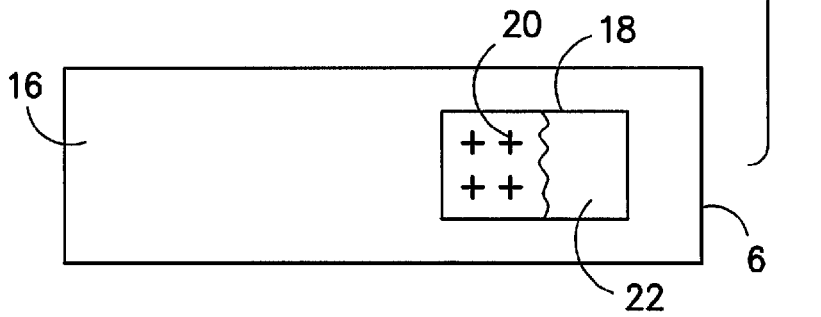
FIG. –1B–
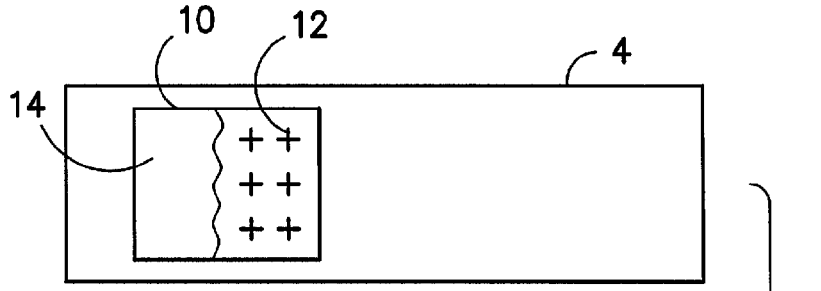
FIG. –2A–
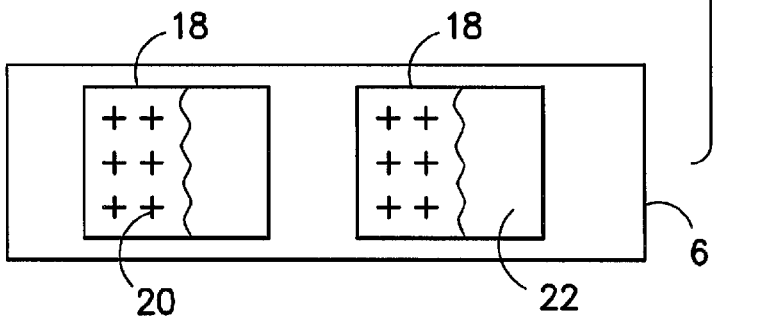
FIG. –2B–

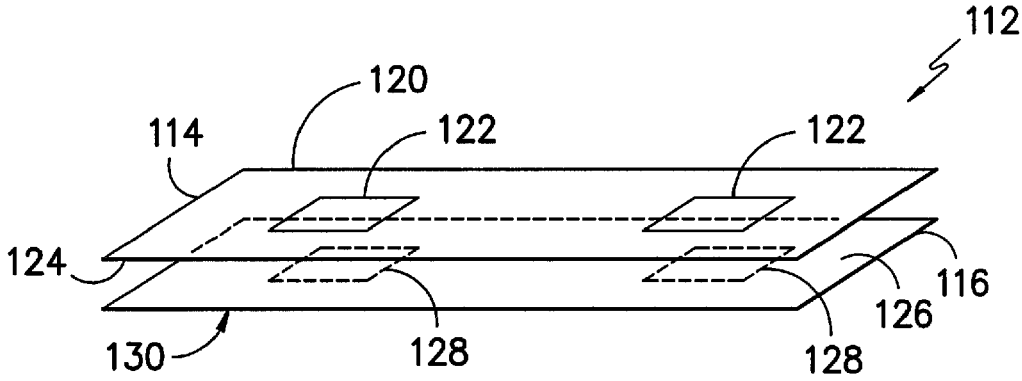
FIG. -3-
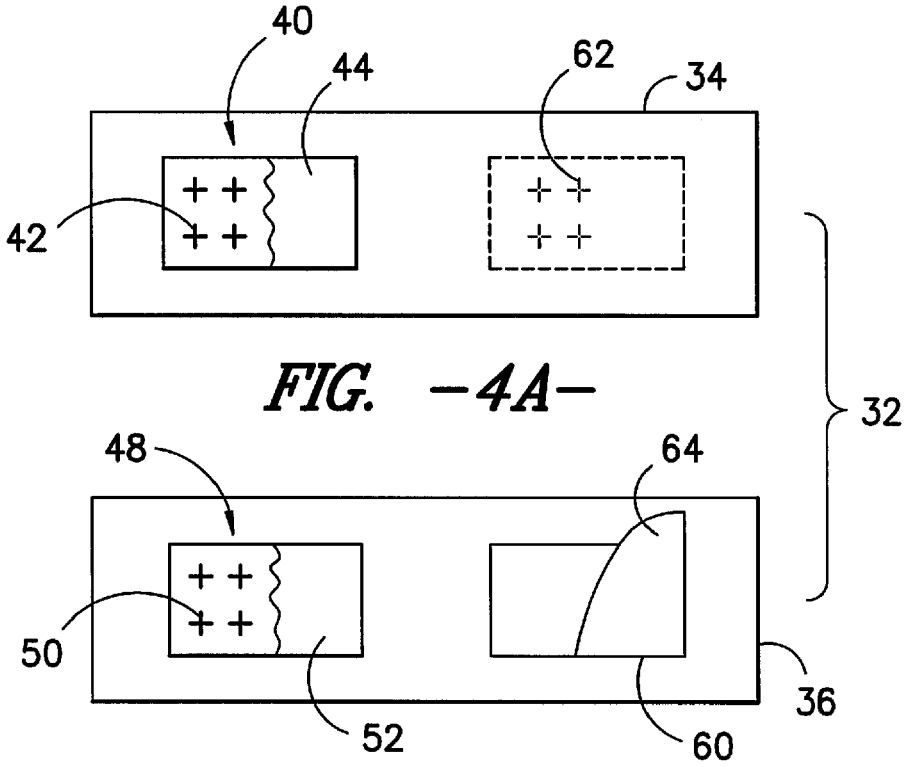
FIG. -4A-
FIG. -4B-

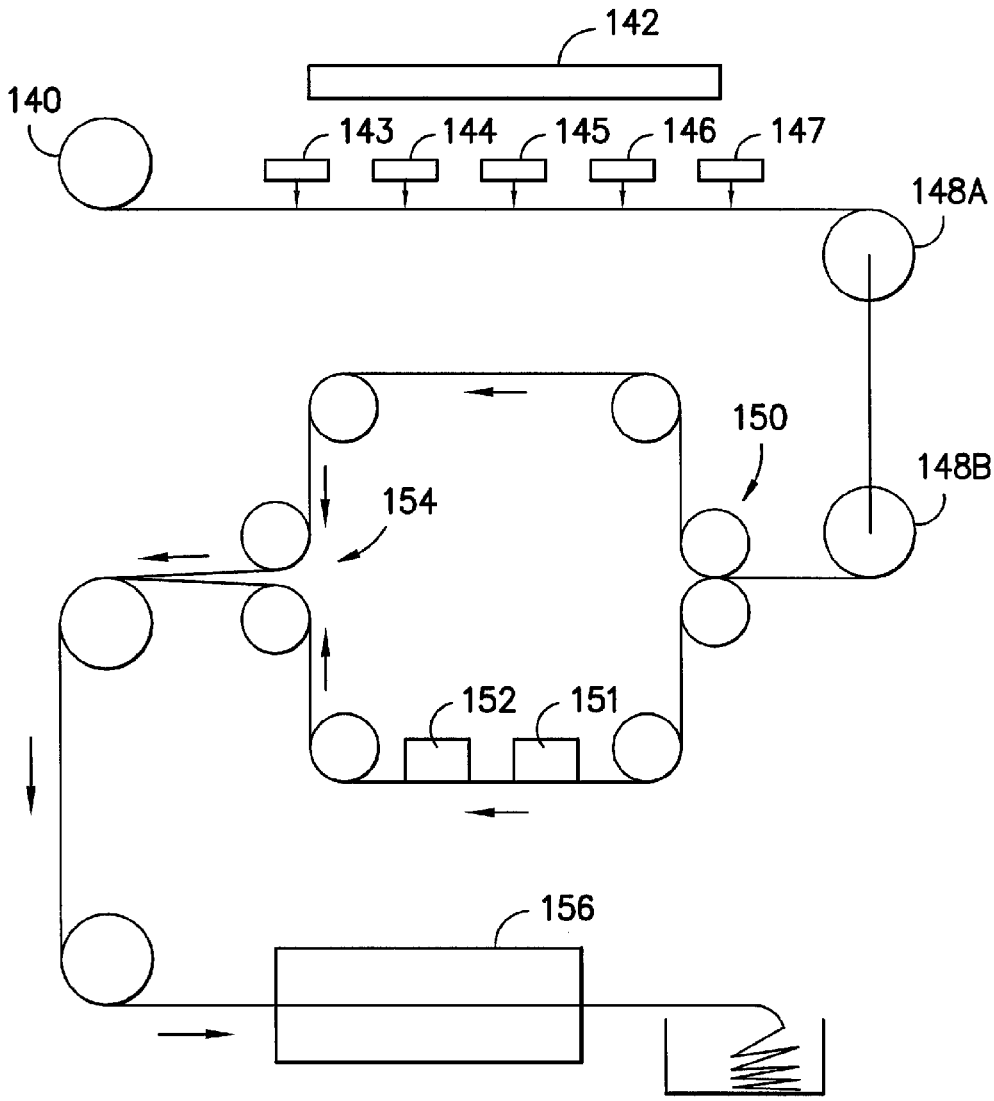
*FIG. –6–*

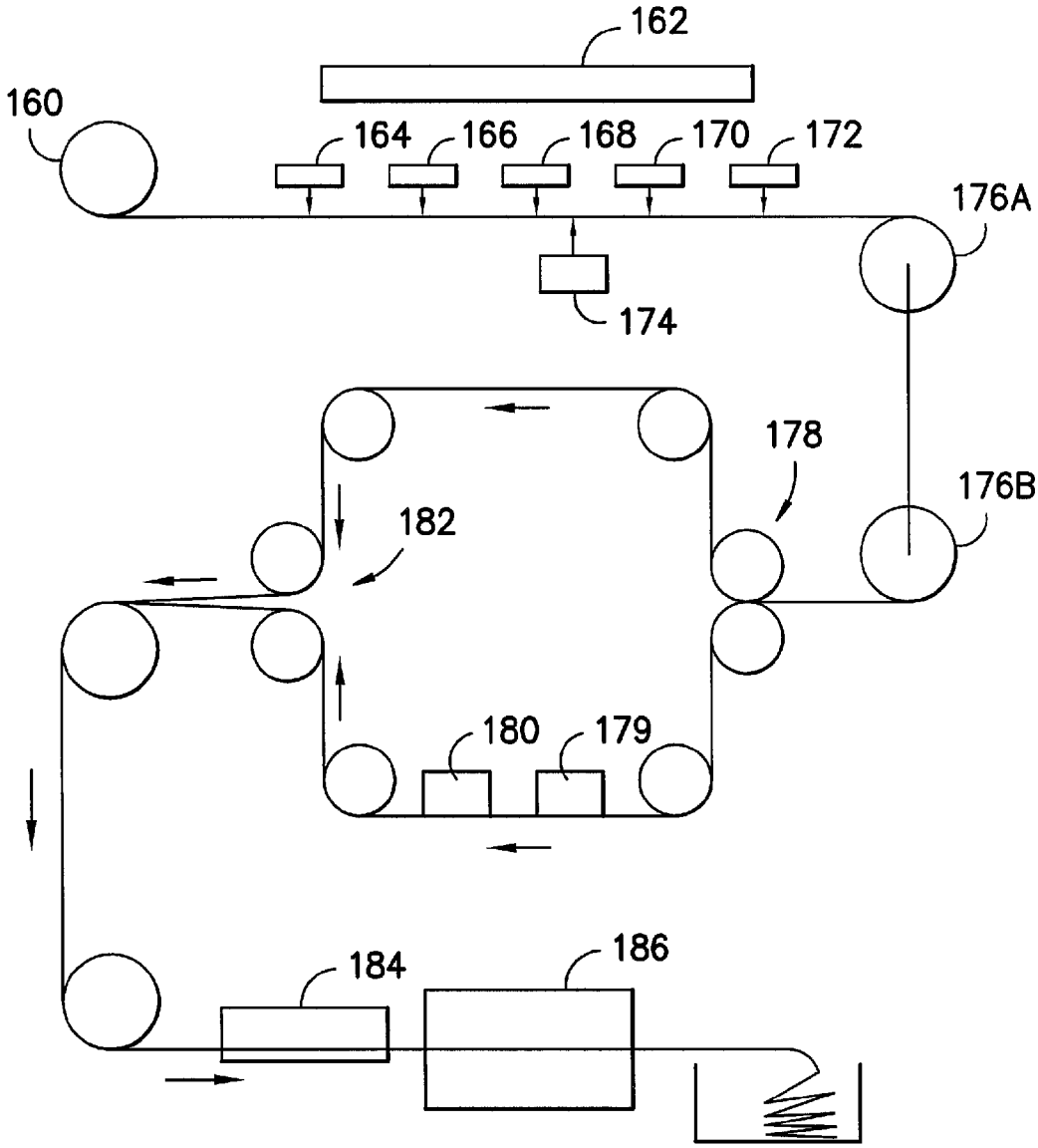
*FIG. –7–*

DOUBLE SIDED SCRATCH-OFF LOTTERY TICKETS AND METHODS OF MANUFACTURING THE SAME

FIELD OF THE INVENTION

The present invention is generally directed to scratch-off lottery tickets in which a scratch-off game is imprinted on both sides of the lottery ticket. The scratch-off lottery ticket of the present invention provides an effective means of increasing the number of lottery games available to the player and provides an added benefit of providing such extra games at a relatively low cost to the lottery ticket manufacturer.

BACKGROUND OF THE INVENTION

Scratch-off lottery tickets are well known in the art in which play indicia appear below a removable scratch-off layer. The player removes the scratch-off layer, thereby exposing the play indicia. If the play indicia meet the requirements of a winning ticket, then the player may claim a prize.

Lottery tickets vary in size but typical scratch-off lottery tickets have a single game printed on one side of the lottery ticket, although some lottery tickets have imprinted more than one game on the same side of the lottery ticket. The game or play side includes play indicia printed beneath a scratch-off layer and other graphics and information which may be relevant to the theme of the game and/or validation/authentication of the lottery ticket.

Efforts have been made to increase the number of games played on a single lottery ticket. One such approach has been to provide multi-panel tickets. The tickets are comprised of two or more panels connected together through fold lines in which the panels may be folded upon each other. However, each panel has a lottery game appearing only on a single side of the lottery ticket. The panels may be folded upon each other to reduce the space occupied by the lottery ticket. However, for each panel, there is a single lottery game with no provision for printing a lottery game on the reverse side of the lottery ticket or panel.

Recently, a technique has been developed to print lottery games on both sides of the lottery ticket. Such efforts have included forming a lottery ticket with a break-open or pull tab construction in which the lottery indicia is covered by a break-open window or pull tab typically made out of paper stock or cardboard. Break-open lottery tickets of the type discussed above are disclosed, for example, in Canadian Patent Document Nos. 2,066,489; 2,282,770; 2,282,777; 2,282,768; and 2,359,581.

Break-open lottery tickets require the formation of a break-open window in which two substrate sheets are laminated together. In order to play the game, the player must lift the break-open window to expose the lottery indicia. Break-open tickets are typically constructed by printing a sheet containing multiple combinations of lottery indicia thereon. The sheet is then cut into sections. The opposite side of the sheet includes prize categories, serial numbers, etc. A second sheet contains break-open windows or pull tabs which are formed in the card stock such that the break-open windows overlap the lottery indicia.

The break-open window type of scratch-off lottery ticket is advantageous because it provides the means of placing lottery games on both sides of a lottery ticket. However, such tickets are more expensive to produce than a typical one sided scratch-off lottery ticket in part because of the necessity of forming a break-open window. No one to date has been able to produce a lottery ticket in which scratch-off games appear on both sides of the ticket without requiring a break-open window because of the anticipated problems in manufacture. In particular, the problems with producing double sided scratch-off lottery tickets include extra layers needed to produce the ticket resulting in a higher rate of production rejection and inadvertent scratching. The scratch-off layers may adhere to production rollers contributing to the high rate of rejection of tickets.

Another problem is the characteristic shrinkage of the lottery card stock during production which can result in loss of capacity to register production on both sides of the ticket. If a technique for printing double-sided lottery tickets could be developed, the lottery tickets produced by such a process would increase the number of lottery games available to player on a single ticket, would make the playing of the game simple and would cost less to fabricate than break-open lottery tickets.

SUMMARY OF THE INVENTION

The present invention is generally directed to a lottery ticket having a front surface and a rear surface in which each of the front and rear surfaces has printed thereon a scratch-off lottery game in which the scratch-off layers are exposed to the player without the player having to first break-open the lottery ticket through the use of a break-open window or pull tab to reach the game area. The lottery ticket of present invention may also be provided with a game that is played with a break-open window but what is required is that there appear on each side of the lottery ticket at least one scratch-off game area that can be played by simply removing the scratch-off layer without having to first break-open and remove a break-open window or tab to expose the lottery game. The lottery games printed on the front and rear surfaces may be related to each other or independent from each other.

Thus, in a first aspect of the present invention, there is provided a lottery ticket comprising a front surface having at least one first scratch-off lottery game printed thereon; and a rear surface having at least one second scratch-off lottery game printed thereon.

In another aspect of the present invention, there is provided a process for preparing a lottery ticket having scratch-off lottery games appearing on both the front and rear surfaces of the lottery ticket. The process comprises applying first lottery play indicia to one surface of the lottery ticket in a first play area; and applying second lottery play indicia to the other surface of the lottery ticket in a second play area and then covering the respective play indicia with a scratch-off system that provides a scratch-off layer over the first and second lottery play indicia.

In a further aspect of the present invention, lottery indicia is applied to separate play areas on the same surface of the substrate and then covered by respective scratch-off layers. The play areas are applied on respective sides of the longitudinal axis of the substrate. The substrate is then slit along its longitudinal axis to create two substrate portions. One of the substrate portions is then turned so that the respective non-play area surfaces face each other. The non-play area surfaces are then engaged to each other, such as by gluing, thus forming a continuous row of scratch-off tickets with scratch-off games on both surfaces of the ticket.

In a further aspect of the invention, a process is provided wherein scratch-off lottery games are printed on both surfaces of the lottery ticket and then the lottery ticket is slit along its longitudinal axis. A break-open window is provided for at least one of the games on one of the surfaces of the lottery ticket. This process enables the production of multiple scratch-off games on opposed surfaces of the lottery ticket along with the additional feature of a break-open game for further amusement of the player.

BRIEF DESCRIPTION OF THE DRAWINGS

The following drawings in which like reference characters indicate like parts are illustrative of embodiments of the invention and are not intended to limit the invention as encompassed by the claims forming part of the application.

FIGS. 1A and 1B are respective views of a lottery ticket in accordance with the present invention in which FIG. 1A is a top view of a scratch-off game on the front face and FIG. 1B is a top view of a scratch-off game on the rear face;

FIGS. 2A and 2B are views similar to FIGS. 1A and 1B in which FIG. 2A shows a lottery ticket with a scratch-off lottery game on the front face and FIG. 2B shows two scratch-off lottery games on the rear face;

FIG. 3 shows a preliminary lottery ticket in production showing the respective front and rear faces separated and the two non-printed portions ready to be engaged to each other;

FIGS. 4A and 4B are respective views of a lottery ticket in accordance with the present invention in which FIG. 4A is a top view of the top surface of the eventual lottery ticket and FIG. 4B is a top view of the rear surface containing a break-open window;

FIG. 6 is a schematic view of a second embodiment of the process of preparing lottery tickets of the present invention; and FIG. 7 is a schematic view of a further embodiment of the process showing lottery tickets of the present invention prepared with a break-open window game.

DETAILED DESCRIPTION OF THE INVENTION

Figure 5:
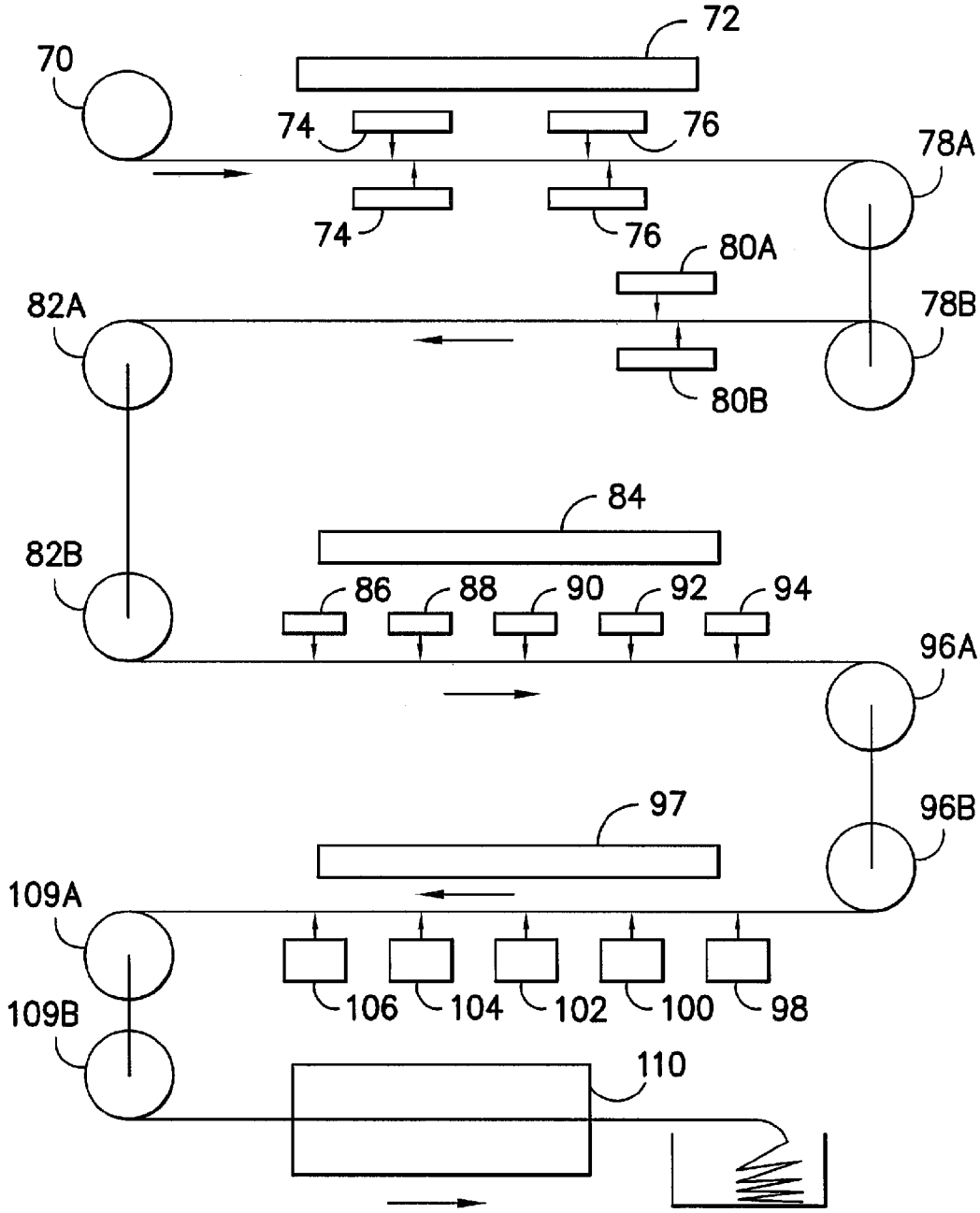
FIG. 5 is a schematic view of a first embodiment of a process for preparing lottery tickets in accordance with the present invention.

The present invention is directed to a lottery ticket with both the front and rear surfaces having imaged thereon at least one scratch-off lottery game. The term "scratch-off game" means that a scratch-off layer must be removed to play the game and can be removed directly by the player without having to first engage a break-open window or pull tab to gain access to the game.

Referring to the drawings and particularly to FIGS. 1A and 1B, there is shown a lottery ticket 2 having a front surface 4 and a rear surface 6. The front surface 4 has a non-play area 8 which may contain graphic information which may include game rules and game theme related images or colors as well as validation/authentication data 19 which can be used to validate/authenticate the lottery ticket such as a bar code which can be read by a lottery sponsored bar code reader. This portion of the front surface 4 is considered the non-play area because the player does not remove a scratch-off layer to reveal play indicia. The front surface 4 also has a play area 10 which contains play indicia 12 covered by a scratch-off layer 14 (the play area 10 is shown with the scratch-off layer 14 partially removed to reveal a portion of the play indicia 12). The scratch-off layer is typically opaque. A scratch-off game within the play area 10 is played as a typical scratch-off game known in the lottery industry. As shown specifically in FIG. 1B, the lottery ticket 2 also has a rear surface 6 which, like the front surface 4, has a non-play area 16 and a play area 18. The play area 18 also contains play indicia 20 covered by a scratch-off layer 22.

The lottery ticket 2 as shown in FIGS. 1A and 1B therefore includes scratch-off games on both the front surface 4 and the rear surface 6 which can be easily and directly accessed and played by the purchaser of a lottery ticket.

Multiple scratch-off lottery games on one or both surfaces may be played on the lottery tickets of the present invention. For example, as shown in FIGS. 2A and 2B, the front surface 4 has a single play area 10 while the rear surface 6 shows two play areas 18 containing play indicia 20 covered by a scratch-off layer 22.

In a further embodiment of the present invention, the lottery ticket may not only include scratch-off games played on both the front and rear surfaces of the lottery ticket but may also include a break-open or pull tab type lottery game appearing on one or both surfaces of the lottery ticket. As used herein the term "break-open" or "pull tab" refers to a lottery game in which a portion of the lottery ticket is in the form of a window or tab which hides the play indicia from view and must be at least partially disengaged from the surface of the lottery ticket and then lifted upwardly and away from the play area to reveal the play indicia.

Referring to FIGS. 4A and 4B, there is shown a lottery ticket 32 having a front surface 34 and a rear surface 36. Both the front surface 34 and the rear surface 36 have respective play areas 40 and 48 in which respective play indicia 42 and 50 are covered by respective scratch-off layers 44 and 52. In accordance with this embodiment of the invention, and as explained hereinafter, the lottery ticket of FIGS. 4A and 4B may also include a break-open play area 60 (shown in a position partially pulled away from play area 60) which includes play indicia 62 covered by a break-open window or tab 64 produced as described hereinafter.

The lottery tickets of FIGS. 1 and 2 may be produced by a process as illustrated in FIG. 5. In general, the front surface of the substrate (e.g. paper board or card stock) which is used to form lottery tickets is provided with graphic information and/or display material, for example, game rules and game theme related images of colors and/or validation/authentication data. This portion of the front surface of the substrate is the non-play area. On the same front surface, there is imaged lottery play indicia in a front surface play area comprising a front surface lottery game based on at least some of the front surface play indicia. At least some of the lottery play indicia are covered with a scratch-off layer, typically an opaque scratch-off layer.

A rear surface is provided with graphic information such as additional rules for playing a rear surface lottery game in an area designated as a rear surface play area and optionally validation/authentication data. At least one of the surfaces is provided with prize determining information. In one region of the rear surface play area, lottery play indicia is imaged in a rear surface play area. The rear surface lottery game may be related to or independent from the front surface lottery game and the front surface play indicia therein. At least some of the rear surface play indicia are covered with a scratch-off layer, typically an opaque scratch-off layer.

Printed on at least one surface of the front and rear surfaces of the substrate is a unique validation/authentication means such as a unique barcode which permits the lottery organization to validate/authenticate both the front and rear surface lottery games. The barcode contains sufficient information about both the front surface game and the rear surface game to validate/authenticate both games through the use of a validation system. The barcode may be of the type used in keyless validation systems such as disclosed in U.S. Pat. No. 6,308,991, incorporated herein by reference.

Referring to FIG. 5, there is shown a roll of substrate such as a roll of paper board or card stock 70 suitable for the production of lottery tickets which is fed to a printing press region 72 which prints graphics including non-play area information by a graphic display assembly 74 and then applies on both surfaces of the substrate seal coats (e.g. lily pads) 76 which are printed in the play areas so that play indicia may be effectively imaged thereon. The substrate is passed through a rewinder roller 78A and transferred to the next station at 78B. The substrate is then fed to an indicia applying stations 80A and 80B such as an ink jet imager where the play indicia are imaged on both surfaces over the lily pads which are applied at station 76.

The printing operation is completed by a single pass through a multi-station continuous formed press or by multiple passes into a limited number of printing/coating unit presses. The printing process is preferably flexography but the process may also use at least some lithographic or rotogravure processing.

Once the play indicia is imaged on both surfaces of the substrate, the substrate is passed to rewinder roller 82A and then transferred to 82B. The substrate containing the imaged play indicia is then fed to a scratch-off layer station 84 where the scratch-off layer is applied over the play indicia through the successive application of an initial seal coat 86, UV varnish 88, scratch-off layer 90, overprint colors 92 and a protective varnish 94 suitable for forming a scratch resistant coating over the scratch-off layer.

Of particular importance to the present invention, there is applied over the scratch-off region, a protective varnish 94 which protects the first scratch-off layer against inadvertent scratching during subsequent processing and particularly to the scratch-off layer applied to the opposite side of the lottery ticket. Once the protective varnish 94 has been applied to the scratch-off region on the front side of the substrate, the substrate is forwarded to rewind roller 96A and then to station 96B. From this position, the substrate is sent to scratch-off layer station 97 wherein the process is repeated to cover the play indicia appearing on the opposite surface of the substrate. In particular, the exposed play indicia is covered with a seal coat 98, a UV varnish layer 100, a scratch-off layer 102, an overprint layer 104 and finally a protective varnish layer 106. Hereagain, a protective varnish layer is provided at the end of the process to prevent against incidental scratches and accidental removal of the scratch-off layer.

The thus prepared substrate is then sent to a rewinder roller 109A and transferred to station 109B. The substrate having the play indicia imaging completed is sent to a processing unit 110 where the substrate is first perforated longitudinally and transversely, slit and folded into the final package form of lottery tickets for delivery to a lottery sponsor. Thus in accordance with the process described in FIG. 5, both surfaces of the lottery ticket are imprinted with play indicia, covered by a scratch-off layer and then protected so that further processing does not adversely affect the scratch-off play regions.

Referring to FIG. 6 there is shown a process by which the substrate is imaged on one surface as a flat web but then is slit along its longitudinal axis to form two web portions (i.e. top and bottom portions) each of which has an upper surface having a scratch-off lottery game appearing thereon and a lower surface. The two lower surfaces of the web portions are engaged together by rotating one of the web portions to thereby form a substrate having scratch-off games on each of the front and rear surfaces.

A lottery ticket of the type produced in accordance with FIG. 6 is shown in FIG. 3. Referring to FIG. 3, the lottery ticket 112 has a top portion 114 and a bottom portion 116.

The top portion has an upper surface 120 having scratch-off lottery games 122 imaged thereon and a lower surface 124. The lower surface 124 has no lottery games imaged thereon. The bottom portion 116 has an upper surface 126 having scratch-off games 128 imaged thereon and a lower surface 130.

At least one of the lower surfaces 124 and 130 is provided some means of engagement such as glue so that the lower surfaces 124 and 130 may be aligned and engaged together thereby providing the upper surface 120 with lottery games 122 which now becomes the front surface of the lottery ticket and the upper surface 126 with lottery games 128 now becomes the rear surface of the lottery ticket. The process of making the lottery tickets of FIG. 3 is described in detail with reference to FIG. 6.

Referring to FIG. 6, there is shown a roll of substrate or web 140 (e.g. paper board or card stock) which is sent to a printing press station 142 where graphic information is provided by a graphic display assembly 143. The substrate then receives seal coats (e.g. lily pads) 144, play indicia 145, scratch-off layer 146 and overprint colors 147. It is important to note that the scratch-off games are imaged on only one surface of the substrate but on opposed sides of the longitudinal axis of the substrate. The thus printed substrate is then wound on rewind roller 148A which is moved to station 148B. The substrate is then slit along the longitudinal axis by a slitter 150 which separates the web 140 along the longitudinal axis into the top portion 114 and the bottom portion 116. The bottom portion is then fed to a station 151 including a turn bar which rotates the bottom portion 116 so that its non-imaged surface (i.e. having no play area) faces upwardly. The non-imaged surface is then glued in station 152. The thus formed web portions and particularly the non-imaged rear surfaces 124, 130 are then aligned and engaged to each other in station 154 to thereby form a substrate containing scratch-off lottery games on both the front and rear surfaces which is sent to processing unit 156 to be packaged as lottery tickets as described above.

In a further aspect of the present invention, a lottery ticket may be provided with scratch-off lottery games on both the front and rear surfaces of the lottery ticket along with a break-open or pull tab style lottery game on either or both surfaces of the lottery ticket to provide additional amusement for the player. A lottery ticket of this type has been previously described in connection with FIG. 4.

The general process of preparing such lottery tickets is shown in FIG. 7 viewed in conjunction with FIGS. 5 and 6. In the embodiment of FIG. 7, scratch-off games are provided on the front surface of the lottery ticket and break-open games on the rear surface. The process of FIG. 7 can be easily modified to place scratch-off games on both surfaces of the lottery ticket as described in connection with FIGS. 5 and 6.

Referring to FIG. 7, the lottery ticket may be produced by having a roll of substrate 160 sent to a printing press station 162 in which a graphic display assembly 164 provides graphic information in at least some of the non-play area. The substrate then has play indicia provided to both surfaces of the substrate with only one of the surfaces (e.g. top surface) of the substrate receiving a scratch-off layer over the play indicia. As shown in FIG. 7, the top surface of the substrate is provided with a seal coat 166. Play indicia is provided thereon in by imager 168, followed by a scratch-off layer 170 and overprint layer 172.

A second imager 174 applies play indicia to the rear surface of the substrate. However, no scratch-off layer is applied over the play indicia applied by the imager 174. The resulting substrate is sent to rewinder roller 176A and then to station 176B. The substrate is then slit along the longitudinal axis by a slitter 178. There is thus formed two substrates or web portions, a top portion having upper and lower surfaces and a bottom portion having upper and lower surfaces. The top surface of the top portion has imaged thereon scratch-off lottery games in designated play areas while the bottom surface of the bottom portion has imaged thereon play indicia in a designed play area which is not covered by a scratch-off layer.

The bottom portion of the substrate is then rotated at station 179 so that the bottom surface and the play indicia imaged thereon faces upwardly and is aligned with the non-play area appearing on the top surface of the top portion. The top and bottom portions are then engaged through gluing station 180 and realignment station 182. The resulting fully imaged substrate now has a front surface having scratch-off lottery games in designated play areas and a non-play area. The rear surface of the substrate has play indicia not covered by a scratch-off layer aligned with the non-play area appearing on the front surface.

The substrate is then forwarded to a die cutting assembly 184 to a die cutting where a die cut is made in the front surface of the substrate in the non-play area immediately above the play indicia not covered by a scratch-off layer to form the break-open window. The resulting substrate is then sent to processing station 186 for forming packaged lottery tickets as described previously.

The process shown in FIG. 7 can be readily modified to print scratch-off lottery games on the bottom surface by adding corresponding seal coat, scratch-off layer, overprint color and protective varnish stations around the imager 174 as described in connection with the embodiment of FIG. 5. Similarly, a protective varnish station would be added to imaging assembly 168 to provide the desired protection to the scratch-off layers when both surfaces of the lottery ticket are provided with scratch-off lottery games as described in connection with FIG. 5.

What is claimed is:

1. A lottery ticket comprising:

a substrate comprising first and second substrate portions, said first substrate portion comprising a front surface and a first non-play area surface, said front surface defining a front surface of the lottery ticket and having at least one first scratch-off lottery game imaged thereon, said first scratch-off lottery game comprising game indicia covered by a scratch-off layer; and said second substrate portion comprising a rear surface and a second non-play area surface, said rear surface defining a rear surface of the lottery ticket, said first and second non-play area surfaces being engaged to each other, said rear surface having at least one second scratch-off lottery game imaged thereon, said second scratch-off lottery game comprising game indicia covered by a scratch-off layer, wherein the engagement of the first and second non-play area surfaces leaves only the front and rear surfaces having scratch-off lottery games thereon exposed.

2. The lottery ticket of claim 1 wherein the first and second scratch-off lottery games are related to each other.

3. The lottery ticket of claim 1 wherein the first and second scratch-off lottery games are independent from each other.

4. The lottery ticket of claim 1 wherein one of the rear and front surfaces further comprise a third lottery game.

5. The lottery ticket of claim 4 wherein the third lottery game comprises game indicia covered by a break-open window.

6. The lottery ticket of claim 1 further comprising validation/authentication means printed on at least one of the rear and front surfaces.

7. The lottery ticket of claim 6 wherein the validation/authentication means appears on one surface of the lottery ticket and comprises sufficient information to enable games on both the front and rear surfaces of the lottery ticket to be validated/authenticated.

8. The lottery ticket of claim 6 wherein the validation/authentication means is covered by a scratch-off layer.

9. The lottery ticket of claim 1 further comprising a protective coating covering at least one of the scratch-off layers.

* * * * *